United States Patent [19]

Tyrey et al.

[11] 4,223,314

[45] Sep. 16, 1980

[54] AM-FM AND CB ANTENNA

[76] Inventors: Elasco A. Tyrey; Rosemary C. Tyrey, both of 239 Estridge, St. Louis, Mo. 63137

[21] Appl. No.: 961,292

[22] Filed: Nov. 16, 1978

[51] Int. Cl.[2] ..... H01Q 1/32

[52] U.S. Cl. ..... 343/715; 343/749

[58] Field of Search ..... 343/749, 752, 895, 900

[56] References Cited

U.S. PATENT DOCUMENTS

| | | | |
|---|---|---|---|
| 2,966,679 | 12/1960 | Harris | 343/895 |
| 3,102,268 | 8/1963 | Foley | 343/895 |
| 3,541,554 | 11/1970 | Shirey | 343/715 |
| 4,095,229 | 6/1978 | Elliott | 343/715 |
| 4,097,867 | 6/1978 | Eroncig | 343/895 |

*Primary Examiner*—Eli Lieberman

*Attorney, Agent, or Firm*—Senniger, Powers, Leavitt and Roedel

[57] ABSTRACT

An antenna for receiving AM and FM radio frequency transmissions and for receiving and transmitting CB radio transmissions. The antenna includes a base, a generally elongate lower antenna section, and a generally elongate upper antenna section. The base is adapted to be mounted on an automobile and connected to the body of the automobile and to the outer conductor of a conventional automobile radio coaxial cable. The lower antenna section is attached to and extends above the base but is insulated therefrom. The electrical length of the lower section is selected to maximize reception of FM radio transmissions, the electrical length and the axial length of the lower section being substantially the same. The lower section is adapted to be connected to the inner conductor of the coaxial cable. The upper antenna section extends above the upper end of the lower section and includes a concealed loading coil electrically connected to the lower section. The cross section of the upper section is substantially the same as that of the upper end of the lower section and the silhouette of the antenna is substantially unbroken where the upper section meets the lower section. The loading coil has a sufficient number of turns to make the electrical length of the antenna at a preselected CB tuning frequency one-quarter of a wavelength. The impedance of the loading coil is such that the electrical length of the antenna at FM frequencies is substantially the same as that of the lower portion alone.

9 Claims, 5 Drawing Figures

AM-FM AND CB ANTENNA

BACKGROUND OF THE INVENTION

This invention relates to radio antennas for use on automobiles and automotive vehicles and more particularly to an antenna for receiving AM and FM radio transmissions and for receiving and transmitting CB radio transmissions and which is not readily identifiable as a CB antenna.

CB transceivers are widely used in automobiles, recreational vehicles and the like for two-way communication on and off the highways. It is usually necessary to install an antenna specially designed for transmissions within the CB frequency range, i.e., 26.965–27.405 MHz, to properly use these transceivers. Unfortunately, these antennas are quite distinctive in appearance and thus readily identify a vehicle on which they are installed as containing CB equipment. As a consequence, persons intent on stealing this type of radio equipment can easily identify vehicles in which they are installed and thefts of mobile CB equipment have been common. This equipment, once stolen, is difficult to trace and is seldom recovered.

One approach to the theft problem involves a removable CB antenna which can easily be removed by the owner and hidden when the vehicle is parked. Another approach is to remove the CB transceiver when the driver leaves the car. A disadvantage of these arrangements is that the user must repeatedly remove and reinstall the antenna or the transceiver. A further disadvantage is that these arrangements fail if the driver forgets to or decides not to remove the antenna or transceiver.

A third approach involves replacing the conventional receiving antenna with which most vehicles having a radio are equipped with a "disguise" antenna, i.e., an antenna that looks like a conventional receiving antenna but which is designed for CB frequency operation. While this may satisfactorily disguise the vehicle to a thief, the performance of the vehicle radio, particularly in receiving FM transmissions, is greatly degraded when using present "disguise" antennas.

SUMMARY OF THE INVENTION

Among the several objects of the invention may be noted the provision of an antenna for receiving AM and FM radio transmissions and for receiving and transmitting CB radio transmissions which is not readily identifiable as CB antenna thereby disguising the fact that a CB transceiver is installed in the vehicle; the provision of such an antenna that need not be frequently removed from its vehicle; and the provision of such an antenna that performs effectively as a CB antenna at CB frequencies without degrading reception at FM frequencies.

Briefly, an antenna of this invention comprises a base adapted to be mounted on an automobile, a generally elongate lower antenna section, and a generally elongate upper antenna section. The base is adapted to be electrically connected to the outer conductor of a conventional automobile radio coaxial cable and to the body of said automobile. The lower section is attached to and extends above the base but is electrically insulated therefrom. The lower section has an electrical length selected to maximize reception of radio frequency transmissions in the FM band, the electrical length and the axial length of the lower section being substantially the same, and is adapted to be connected to the inner conductor of the conventional automobile radio coaxial cable. The upper section extends above the upper end of the lower section and includes a concealed loading coil electrically connected to the lower section, the, cross section of the upper section being substantially the same as that of the upper end of the lower section. The silhouette of the antenna is substantially unbroken where the upper section meets the lower section, thereby disguising the fact that the upper section includes a loading coil. The loading coil has a sufficient number of turns to make the electrical length of the antenna at a preselected CB tuning frequency substantially one-fourth the wavelength of a radio transmission of the preselected frequency, the electrical length of the antenna at the preselected frequency being greater than the axial length of the antenna above the base. The impedance of the loading coil is such that the electrical length of the antenna at FM frequencies is substantially the same as that of the lower portion. As a result, the reception and transmission characteristics of the antenna at CB frequencies are improved and the FM reception characteristics of the antenna are substantially unimpaired.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
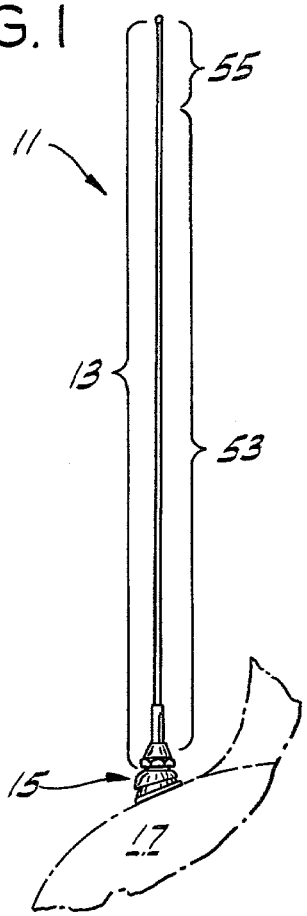
FIG. 1 is a perspective of an antenna of the present invention mounted on a vehicle.

Referring now to the drawings, there is shown in FIG. 1 an antenna 11 having a mast 13 secured to a swivel ball mount 15, the latter permitting the antenna to be mounted on a sheet metal surface such as the cowl or other portion of an automobile or other vehicle. A portion of such a vehicle is shown at 17.

Figure 2:
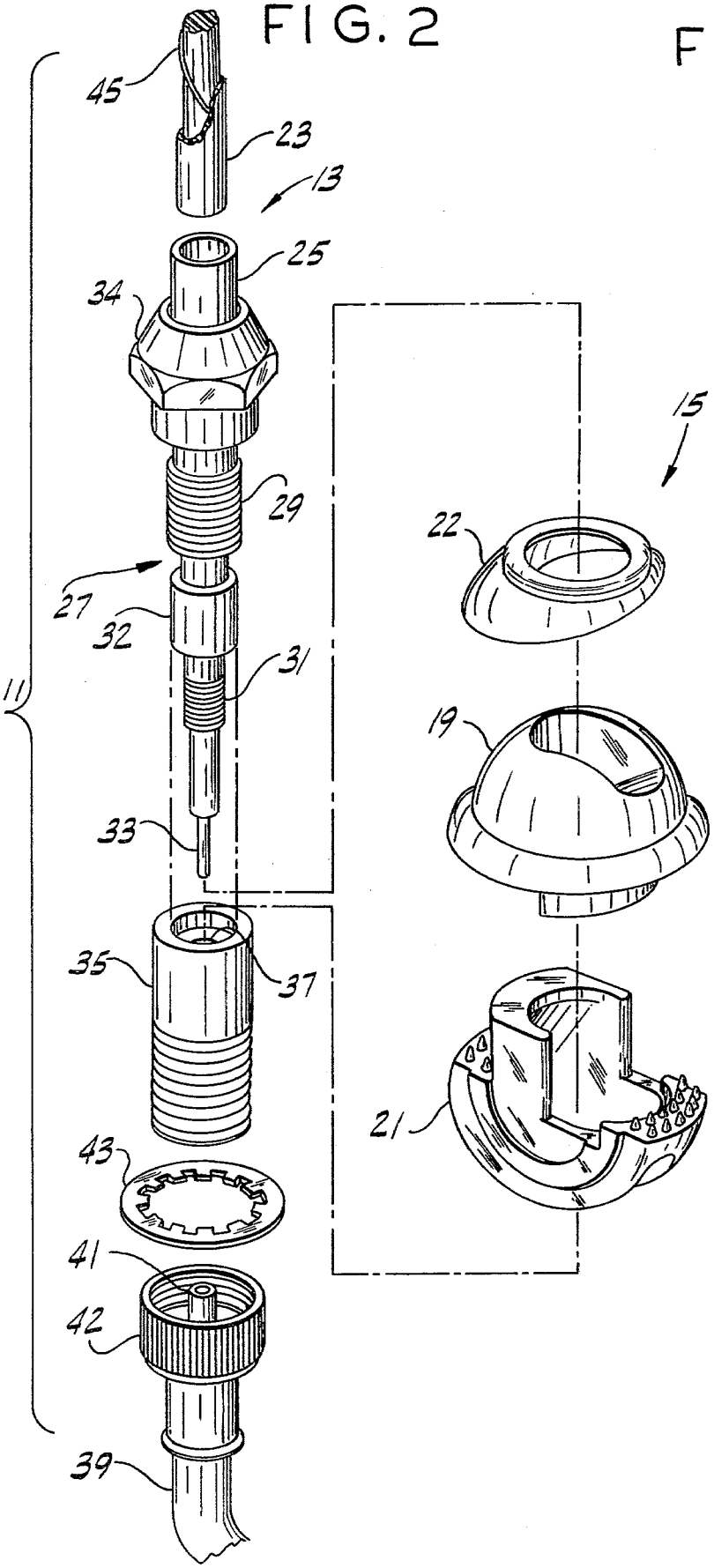
FIG. 2 is an exploded perspective of the base and a portion of the lower section of an antenna of the present invention.

As is shown in more detail in FIG. 2, the swivel ball mount consists of a hemispherical plastic bushing 19 having an arcuate slot extending therethrough, a mating metallic rocker 21 having a plurality of prongs for making good electrical contact with the body of the vehicle to which antenna 11 is secured, and a shield 22. When antenna 11 is assembled, mast 13 extends through the arcuate slot and shield 22 covers that portion of said slot not occupied by the mast.

Mast 13 includes a fiberglass rod 23, a hollow metallic rod 25 into which the lower end of fiberglass rod 23 fits and to which it is secured by gluing or the like, and a metallic shank 27 extending downwardly from the lower end of rod 25. (As used herein, the term "fiberglass" means an insulative composition of glass fibers and a cured synthetic resin.) Shank 27 has an upper threaded portion 29 and a reduced lower section with a lower threaded portion 31. The shank carries an insulating spacer sleeve 32 intermediate threaded portions 29 and 31 and it terminates in a terminal pin 33. When the antenna is assembled, an internally threaded nut or cap 34 is threaded onto upper threaded portion 29. And a bushing 35 having an insulated, internally threaded bore 37 is screwed onto lower threaded portion 31 and receives rocker 21. Terminal pin 33 of shank 27 extends through bushing 35.

Antenna 11 is electrically connected to a conventional, i.e., 80Ω, automobile radio coaxial cable 39 having inner and outer connector terminals 41 and 42 connected to the inner and outer (or shield) conductors of cable 39 respectively. When connector 42 is threaded onto bushing 35, a washer 43 and the shoulder of the connector serve as a seat for the arcuate undersurface of rocker 21. Threading connector 42 onto bushing 35 also forces connector 41 into good electrical contact with terminal pin 33.

To install antenna 11 on a vehicle, cable 39 is slipped through a suitably placed aperture in the sheet metal of the vehicle's body and rocker 21 is rotated to one side so that it will slip through the aperture. After the rocker has passed through the aperture, the antenna is temporarily held in place and rocker 21 is allowed to resume the orientation shown in FIG. 2, thereby preventing its removal. Cap nut 34 is then tightened on threaded portion 29. As this happens, the prongs of rocker 21 are forced into engagement with the underside of the sheet metal surrounding the aperture in which the antenna is mounted, thereby providing good electrical grounding contact between the body of the vehicle and rocker 21 and the outer conductor of cable 39. In addition, hemispherical bushing 19 is forced downwardly into mating engagement with rocker 21.

It should be appreciated that only that part of antenna 11 extending above the body of the vehicle i.e., in general above rocker 21, contributes to its electrical length. Rocker 21 constitutes, in effect, a physical and electrical base for antenna 11 which is adapted to be mounted on an automobile (i.e., any automotive vehicle) and which is also adapted to be electrically connected to the outer conductor of cable 39 and to the body of the automobile. Even though mast 13 extends somewhat below base or rocker 21, only that part of the mast extending above the rocker contributes to the antenna's electrical length.

Figure 3:
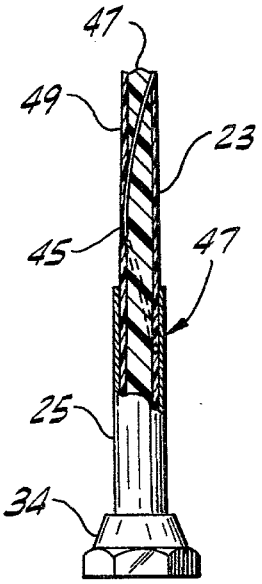
FIG. 3 is an elevation with parts broken away of a part of the lower section of an antenna of the present invention, on a reduced scale.

A 10 mil (0.0254 cm) copper wire 45 is carried by fiberglass rod 23, said wire extending substantially from the bottom to the top of rod 23. Wire 45 is electrically connected to metallic rod 25, as is generally shown at 47 (see FIG. 3). Fiberglass rod 23 consists of a fiberglass core 47 which carries wire 45 on its outer surface and a fiberglass coating or outer layer 49 which conceals wire 45 from view. Of course, rod 23 need not have this construction. All that is required is that wire 45 not be readily visible, and there are many constructions which can accomplish this.

Wire 45 is substantially straight (i.e., its inductance is negligible) from the point where it is connected to metallic rod 25 until it reaches a height of 32 inches (81 cm) above base or rocker 21. Above that height it is closely wound (e.g., 90–95 turns/inch) around core 47 in a single layer for about 7.75 inches (19.69 cm) to form a concealed loading coil 51 of, for example, 725 turns. The point 32 inches (81 cm) above the base, where wire 45 makes the change from being substantially straight to being closely wound, divides antenna 11 into two sections, viz, a generally elongate lower antenna section 53 and a generally elongate upper antenna section 55. The length of lower section 53 is 32 inches (81 cm), a common length for antennas designed to resonate in the FM band and one which maximizes reception of radio frequency transmissions in the FM band (since thirty-two inches corresponds to an electrical length of one-quarter of a wavelength at about 90 MHz). Lower section 53, being part of mast 13, is attached to and extends above rocker 21 but is electrically insulated therefrom. By means of metal shank 27, and in particular by means of terminal pin 33, lower section 53 is connected to the inner conductor of cable 39.

Figure 4:
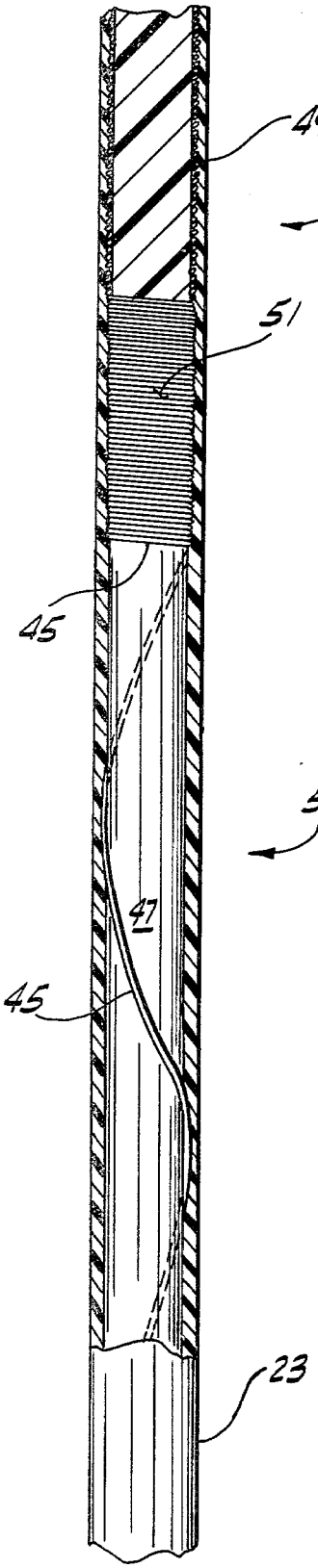
FIG. 4 is a partial section on an enlarged scale of a segment of an antenna of the present invention showing the upper end of the lower section and the lower end of the upper section.

Upper antenna section 55 extends above the upper end of the lower section, i.e., above the 32 inch (81 cm) point, for about 7.75 inches (19.69 cm). Of course, fiberglass rod 23 may extend upwardly beyond the end of upper section 55, but it is preferred that it not extend so far past the end of said section as to cause antenna 11 to cease to closely resemble a conventional AM-FM receiving antenna. Although wire 45 is closely wound in upper section 55, and substantially straight in lower section 53, this fact is not apparent or even noticeable to one looking at antenna 11. As shown in FIG. 4, coating 49 covers wire 45 uniformly throughout the length of fiberglass rod 23, thereby making the upper and lower sections indistinguishable from each other. (For clarity, the thickness of coating 49 has been exaggerated. It is preferred that this thickness be comparable to the diameter of wire 45 since it has been found that a layer of this thickness adequately conceals wire 45). As a result, the cross sections of the upper end of the lower section and the lower end of the upper section are substantially the same and the silhouette of the antenna is substantially unbroken where the upper and lower sections meet, thereby disguising the fact that antenna 11 differs from conventional AM-FM receiving antennas.

There is quite a contrast in appearance between antenna 11 and conventional top loaded CB antennas. These CB antennas have a loading coil that is clearly visible. Antenna 11 does not. In addition, dimensions of antenna 11 are chosen to resemble conventional AM-FM receiving antennas, not CB antennas. For example, metallic rod 25 has a diameter of about 9/32 inch (0.71 cm) and fiberglass rod 23 uniformly tapers from about ¼ inch (0.63 cm) where it is secured to metallic rod 25 to about ⅛ inch (0.32 cm) at its top. These dimensions are essentially those of a conventional automotive AM-FM antenna and are chosen to provide strength and flexibility to antenna 11, but the present invention is not limited to these dimensions.

Figure 5:
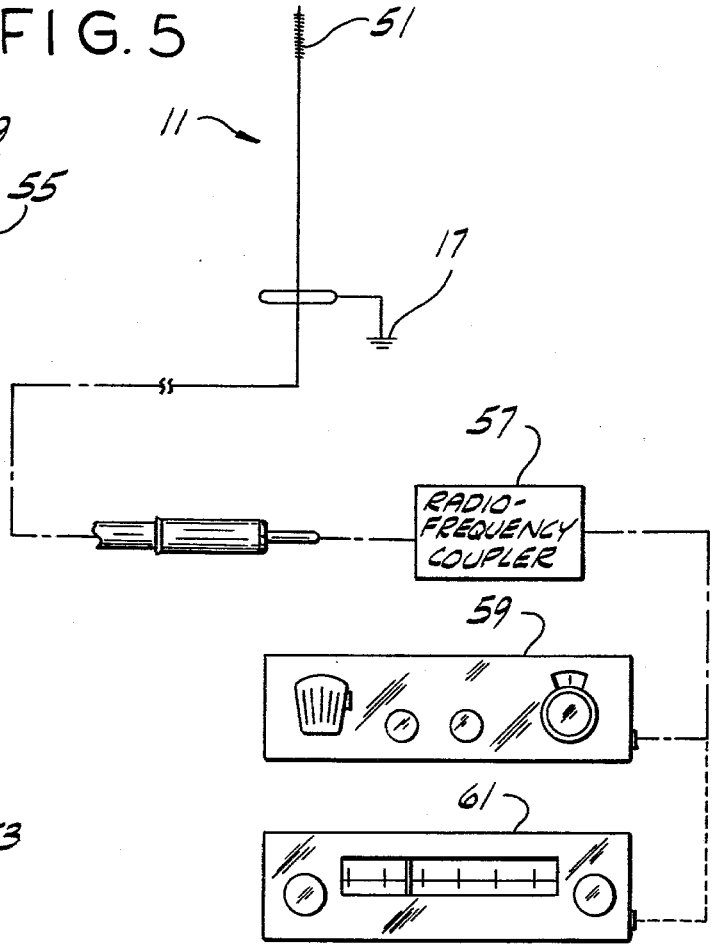
FIG. 5 is a schematic diagram of an antenna of the present invention showing the preferred method of connection to CB and AM-FM radios.

Even though antenna 11 looks like a conventional AM-FM antenna, it does not transmit and receive CB frequency transmission as ineffeciently as such an antenna. Concealed loading coil 51, which is electrically connected to the lower section of antenna 11, causes the antenna to resonate at a preselected CB tuning frequency of about 28 MHz, i.e., the electrical length of antenna 11 at 28 MHz is one-quarter of a wavelength. This frequency, which is slightly above the CB band, was selected to give the best VSWR for antenna 11 across the CB band when the antenna is used with a radio-frequency coupler 57 (see FIG. 5) such as is shown in U.S. Pat. No. 4,036,177. The VSWR of antenna 11 when used with coupler 57 is no greater than about 1.5:1 throughout the CB band and at channel 19 is essentially 1:1. In FIG. 5, antenna 11 is shown connected through coupler 57 to both a CB transceiver 59 and an AM-FM receiver 61.

Of course, the number of turns of coil 51 may be changed to cause antenna 11 to resonate at any particular CB tuning frequency. And radio-frequency coupler 57 need not be used with antenna 11 since it works satisfactorily without the coupler. If the coupler is not used, antenna 11 should be tuned to the middle of the CB band (by changing the number of turns of coil 51).

Antenna 11 not only has good CB transmission characteristics, but also has excellent FM reception characteristics. The impedance of loading coil 51 is so great at FM frequencies that FM radio transmissions do not "see" the loading coil. Consequently, at FM frequencies the antenna is effectively a straight wire antenna having a length of about 32 inches (81 cm) and an electrical length of about one-quarter of a wavelength (the same as that of lower section 53). That is, the electrical length of antenna 11 at FM frequencies is substantially determined by the height of lower antenna section 53. Thus, antenna 11, although it is one integral unit physically, behaves like two separate antennas—one designed for excellent FM reception characteristics and the other designed to transmit and receive CB transmissions better than conventional AM-FM antennas. It has been found that the presence of loading coil 51 also increases the electrical length of antenna 11 somewhat at AM frequencies with a concomitant improvement in AM reception.

Antenna 11 is manufactured as follows: Wire 45 is first temporarily taped to tapered fiberglass core 47 to hold it in position with respect thereto. Coating 49 is then applied with the resin in a stage B condition, i.e., viscous and moldable, to cover wire 45 and core 47 and form fiberglass rod 23. Rod 23 is then heated to complete the curing of coating 49, thereby concealing wire 45. Silver epoxy paint is then applied over coating 49 to cause the antenna mast to have the same metallic color as conventional AM-FM antennas. This color could be directly incorporated as a pigment into coating 49, which would eliminate the painting step. Fiberglass rod 23 is then suitably attached and connected to hollow metallic rod 25 and shank 27.

It is not necessary to use a single wire 45 in making antenna 11. For example, two physically distinct wires can be used, one straight wire in lower antenna section 53 and another in upper section 55 to form loading coil 51. These wires can be directly connected by soldering or the like. However, it is preferred that these two wires be parts of a single wire, such as wire 45. Nor is it necessary that fiberglass rod 23 be a one-piece rod. A section of fiberglass rod carrying only the loading coil, for example could be glued onto the top of another rod which terminated at the top of lower section 53. But the present one-piece construction of rod 23 provides improved structural integrity.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An antenna for receiving radio frequency transmissions in the AM and FM radio frequency bands and for receiving and transmitting CB radio transmissions, comprising:

a base adapted to be mounted on an automobile, said base also being adapted to be electrically connected to the outer conductor of a conventional automobile radio coaxial cable and to the body of said automobile;

a generally elongate lower antenna section attached to and extending above the base but electrically insulated therefrom, said lower section having an electrical length selected to maximize reception of radio frequency transmissions in the FM band, said electrical length at a predetermined FM frequency being substantially one-fourth the wavelength of a radio transmission at said predetermined frequency, the electrical length and the axial length of said lower section being substantially the same, said lower section being adapted to be connected to the inner conductor of said conventional automobile radio coaxial cable; and a generally elongate upper antenna section extending above the upper end of the lower section and including a concealed loading coil electrically connected to the lower section, the cross section of the upper section being substantially the same as that of the upper end of the lower section, the silhouette of the antenna being substantially unbroken where the upper section meets the lower section, thereby disguising the fact that the upper section includes a loading coil, said loading coil having a sufficient number of turns to make the electrical length of said antenna at a preselected CB tuning frequency substantially one-fourth the wavelength of a radio transmission of said preselected frequency, said electrical length of the antenna at the preselected CB tuning frequency being greater than the axial length of the antenna above the base, the impedance of the loading coil being such that the electrical length of the antenna at FM frequencies is substantially the same as the axial length of the lower section, whereby the reception and transmission characteristics of the antenna at CB frequencies are improved and the FM reception characteristics of the antenna are substantially unimpaired.

2. An antenna as set forth in claim 1 wherein the upper and lower antenna sections include a one-piece fiberglass rod for providing strength, flexibility and structural integrity to the antenna, and wherein the lower antenna section includes a first thin, conductive wire carried by said fiberglass rod and extending to the upper end of said lower antenna section, the electrical length of the antenna at FM frequencies being substantially determined by the height of said lower section.

3. An antenna as set forth in claim 2 wherein the fiberglass rod includes a fiberglass core, wherein the first thin, conductive wire is carried on the outer surface of the fiberglass core and wherein the antenna further includes a thin fiberglass coating over said wire and the fiberglass core which conceals said wire from view.

4. An antenna as set forth in claim 2 wherein the fiberglass rod includes a fiberglass core, wherein the concealed loading coil is comprised of a second thin, conductive wire closely wound on said fiberglass core, said second wire being electrically connected to said first wire, and wherein the rod further includes a thin fiberglass coating over said loading coil which conceals said coil from view.

5. An antenna as set forth in claim 4 wherein the first and second wires are parts of a single thin, conductive wire.

6. An antenna as set forth in claim 2 wherein the lower antenna section includes a terminal at its lower end for connection to the inner conductor of said conventional automobile radio coaxial cable, said fiberglass rod being secured to and extending above said metallic rod, the first wire being electrically connected to said metallic rod.

7. An antenna as set forth in claim 1 wherein the concealed loading coil is comprised of a thin, conductive wire carried by a rod of an insulating material.

8. An antenna as set forth in claim 7 wherein the rod includes a core of insulating material and wherein the concealed loading coil is carried on the outer surface of the core, the antenna further including a thin coating of an insulating material over said loading coil which conceals it from view, the upper section of said antenna with said insulating coating being not significantly larger in cross section than the lower antenna section.

9. An antenna as set forth in claim 8 wherein the core is a fiberglass core and the coating is also of fiberglass.

* * * * *